United States Patent [19]

Hurst

[11] Patent Number: 4,892,262

[45] Date of Patent: Jan. 9, 1990

[54] LEVEL WINDER FOR WINCH

[75] Inventor: George H. Hurst, Redlands, Calif.

[73] Assignee: George Hurst Level Winders, Inc., Los Angeles, Calif.

[21] Appl. No.: 191,793

[22] Filed: May 3, 1988

Related U.S. Application Data

[63] Continuation of Ser. No. 9,098, Jan. 21, 1987, abandoned, which is a continuation of Ser. No. 780,614, Sep. 26, 1985, abandoned.

[51] Int. Cl.[4] ..... B65H 57/28

[52] U.S. Cl. ..... 242/157.1

[58] Field of Search ..... 242/157.1

[56] References Cited

U.S. PATENT DOCUMENTS

| | | | |
|---|---|---|---|
| 736,472 | 8/1903 | Anderson | 242/157.1 |
| 2,473,628 | 6/1949 | Allison | 242/157.1 |
| 3,248,088 | 4/1966 | Benson et al. | 242/157.1 |
| 4,515,329 | 5/1985 | Sandvik | 242/157.1 |

FOREIGN PATENT DOCUMENTS

| | | | |
|---|---|---|---|
| 526862 | 9/1940 | United Kingdom | 242/157.1 |

*Primary Examiner*—Stanley N. Gilreath

*Attorney, Agent, or Firm*—Christie, Parker & Hale

[57] ABSTRACT

A level winder for a winch has a cable control element movable between the edges of the drum of the winch in a manner that defines two cable path segments, the sum of the lengths of which remain constant. The first cable path segment extends from a fleet point, i.e., a stationary point relative to the winch, to the cable control element. The second cable path segment extends from the cable control element to the end of the helical configuration on the drum of the winch, i.e., the point on the drum where the cable must be laid down to continue the contiguous helical turns. Preferably, the cable control element is an arm pivotally mounted on a carrier frame to swing back and forth from edge to edge of the drum in a plane parallel to the drum axis. The carriage on which the cable control arm is mounted is pivotally mounted relative to the drum so the axis of rotation of the carriage interesects the axis of rotation of the cable control arm. The carrier is itself pivotally mounted to rotate about the axis of the drum. A cable tensioner maintains tension on the cable when the cable is not tensioned by a load. A no-load lock on the cable control arm maintains the cable control arm at a position above the end of the helical configuration when the cable-winding operation is interrupted. A damping element prevents unrestrained movement of the cable control arm when subjected to abrupt forces.

5 Claims, 5 Drawing Sheets

LEVEL WINDER FOR WINCH

This is a continuation of application Ser. No. 07/009,098 filed Jan. 21, 1987, now abandoned, which is a continuation of application Ser. No. 06/780,614 filed Sept. 26, 1985, now abandoned.

BACKGROUND OF THE INVENTION

This invention relates to cable-handling equipment and, more particularly, to a level winder for a winch.

A level winder controls the path of a cable as it is wound on the drum of a winch so the cable is wrapped in contiguous helical turns extending from edge to edge of the drum without crossing over one another. As used herein, the term cable encompasses steel cable, rope, wire, and other types of lines for tensional transmission of force. Such a configuration of continuous edge-to-edge helical turns provides the most efficient utilization of storage space on the drum, permits the smoothest and most reliable payout of cable from the drum, and protects the cable from damage. Steel cables are particularly vulnerable to damage because of their limited flexibility. If one turn of a steel cable jumps off the prescribed contiguous helical path and crosses over another turn, the steel cable is subjected to a much sharper bending arc at the point of crossover than the bending arc presented by the drum, which, depending on the tension on the cable frequently permanently deforms, weakens, and destroys the cable. For these reasons, it is important that a level winder operate efficiently and reliably.

The diameter of a cable changes as a function of the tension exerted thereon, depending upon the modulus of elasticity of the cable material. Presently available level winders have a cable guide that is mechanically coupled to the drum by reversible gearing or screw threads so as to be driven responsive to the rotation of the winch. Such arrangements are generally not able to adjust the pitch of the helical turns as the cable diameter changes. Thus, in order to prevent crossing of the cable or gaps between helical turns, the cable tension must be maintained within prescribed limits.

SUMMARY OF THE INVENTION

According to the invention, a level winder for a winch has a cable control element movable between the edges of the drum of the winch in a manner that defines two cable path segments, the sum of the lengths of which remain constant. The first cable path segment extends from a fleet point, i.e., a stationary point relative to the winch, to the cable control element. The second cable path segment extends from the cable control element to the end of the helical configuration on the drum of the winch, i.e., the point on the drum where the cable must be laid down to continue the contiguous helical turns.

Preferably, the cable control element is an arm pivotally mounted on a carrier frame to swing back and forth from edge to edge of the drum in a plane parallel to the drum axis. The carriage on which the cable control arm is mounted is pivotally mounted relative to the drum so the axis of rotation of the carriage interesects the axis of rotation of the cable control arm. Preferably, the carrier is itself pivotally mounted to rotate about the axis of the drum. In summary, the cable control arm is freely pivotal, subject to the influence of the cable, about three axes, two of which are parallel to each other and the third of which is perpendicular to the other two.

A feature of the invention is a cable tensioner to maintain tension on the cable when the cable is not tensioned by a load.

Another feature of the invention is a no-load lock on the cable control arm, which maintains the cable control arm at a position above the end of the helical configuration when the cable-winding operation is interrupted. As a result, it is not necessary to reset the position of the cable control arm when the cable-winding operation is resumed.

Another feature of the invention is a damping element to prevent unrestrained movement of the cable control arm when subjected to abrupt forces, such as would occur at sea or on a bumpy road.

BRIEF DESCRIPTION OF THE DRAWINGS

The features of a specific embodiment of the best mode contemplated of carrying out the invention are illustrated in the drawings, in which.

DETAILED DESCRIPTION OF THE SPECIFIC EMBODIMENT

Figure 1:
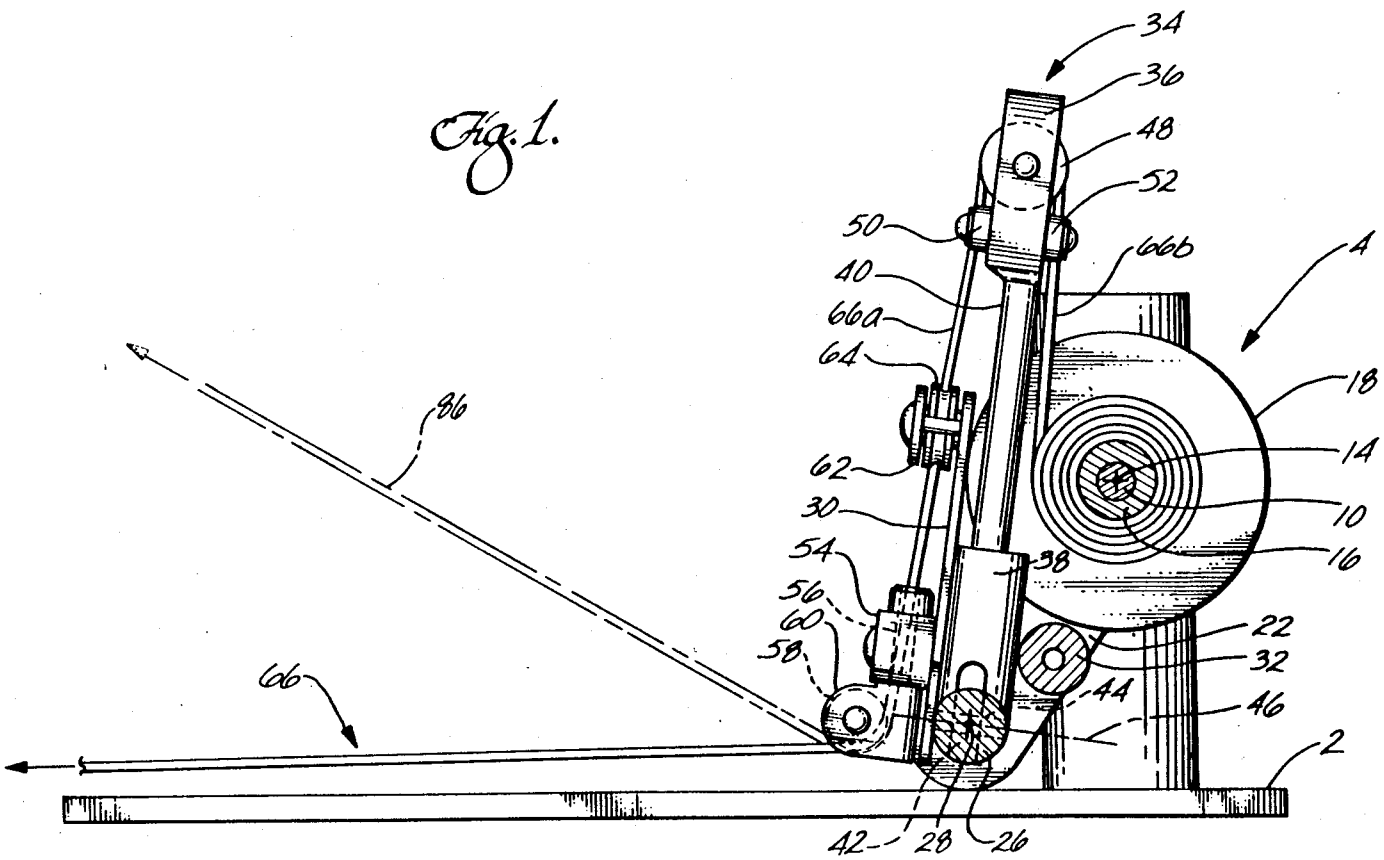
FIG. 1 is a side, partially sectional view of a level winder and a winch incorporating principles of the invention.
Figure 2:
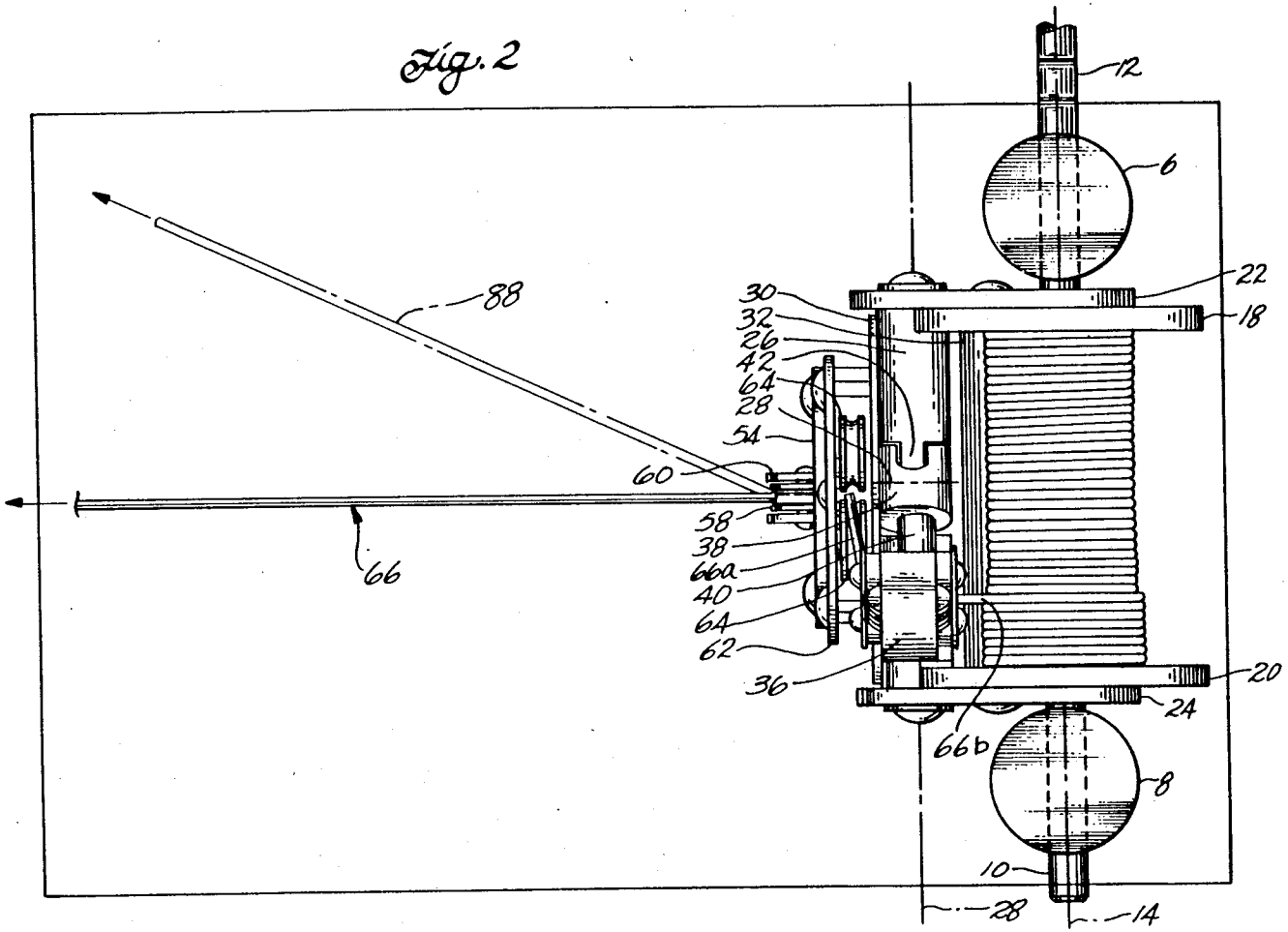
FIG. 2 is a top plan view of the level winder and winch of FIG. 1.
Figure 3:
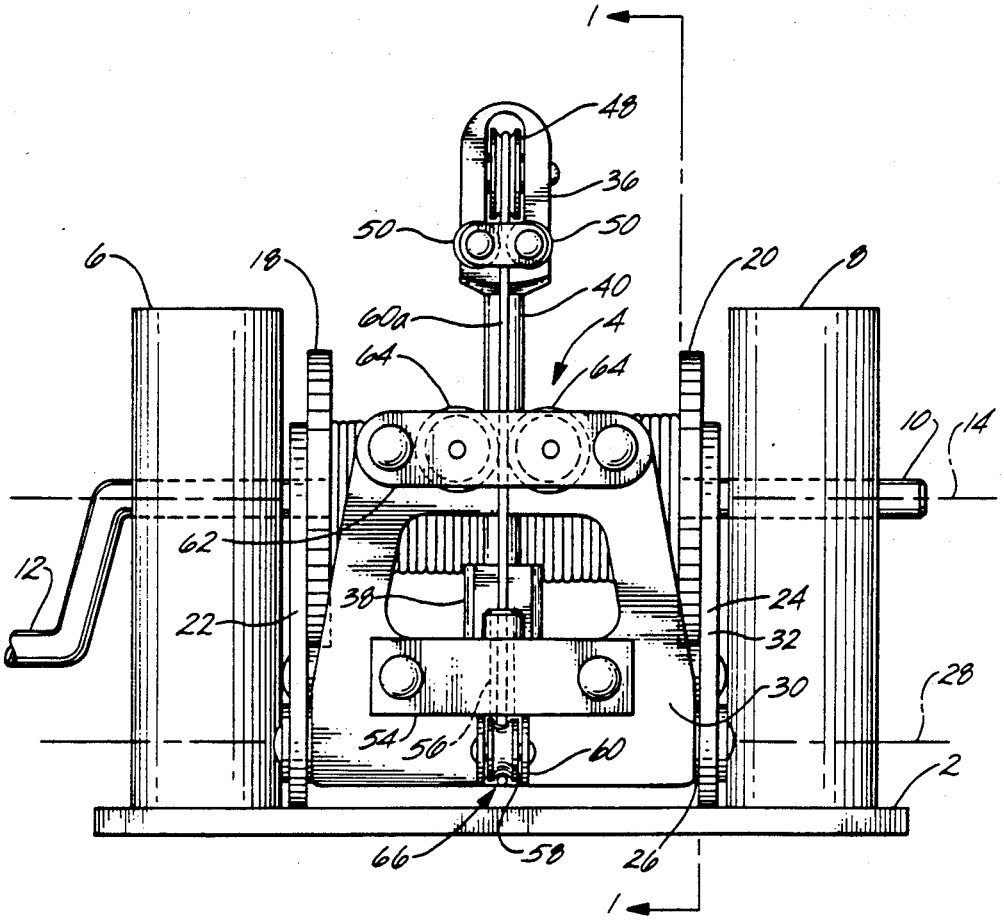
FIG. 3 is a front elevation view of the level winder and winch of FIG. 1.

In FIGS. 1, 2, and 3, a base 2, which could comprise the bed of a truck, the deck of a ship, or a stationary platform, serves as a mounting surface for a winch 4. Spaced apart vertical posts 6 and 8 are secured to base 2. An axle 10 having a crank arm 12 is journalled by bearings not shown for rotation within posts 6 and 8 about first axis 14 that is parallel to the surface of base 2. A drum 16 having flanges 18 and 20 at its respective edges is fixed on axle 10 between posts 6 and 8. Bars 22 and 24 are fixed to flanges 18 and 20, respectively, outboard of drum 16. An axle 26 is journalled by bearings not shown for rotation in bars 22 and 24 about an axis 28, which is parallel to axis 14. A carrier frame 30 is fixed to and supported by axle 26 to pivot therewith with respect to winch 4. A bar 32 extends between and is secured to bars 22 and 24 to serve as a stop on the rotation of carrier frame 30 about axis 28 in the direction toward winch 4, as illustrated in FIG. 1. As also illustrated in FIG. 1, the surface of base 2 serves as a stop on the downward rotation of bars 22 and 24 about axis 14 to prevent axle 26 from moving below axle 10 of drum 16. A cable control arm 34 has a distal yoke 36 and a base 38 joined by a shank 40. The control arm 34 has a cable approach side on the side of approaching cable 66 (to the left in FIG. 1) and a drum approach side, or the side facing towards drum 16. Axle 26 has a centrally located flat 42 (FIG. 1) that supports and is straddled by a yoke at the end of base 38 of cable control arm 34. Base 38 pivotably connected to flat 42 by a pin 44 for rotation about a second axis 46, which intersects axis 28. As a result, cable control arm 34 is freely pivotal in a plane parallel to first and second axes 14 and 28. A direction reversing pulley 48 is mounted for rotation between the arms of yoke 36. Pulley 48 rotates about an axis parallel to axis 28. Below pulley 48, a pair of adjacent guide rollers 50 on the cable approach side of arm 34 are mounted on the side of yoke 36 facing away from winch 4. Below pulley 48, a pair of adjacent guide rollers 52 are mounted on the drum approach side of yoke 36 facing toward winch 4. Rollers 50 and 52 turn about parallel axes extending parallel to second control arm axis 46. At the bottom of carrier frame 30, a cable guide 54 having a central upwardly extending passage 56 is secured on the side of frame 30 facing away from winch 4. A pulley 58 is mounted in a frame 60 which is pivotally attached to the bottom of cable guide 54 so that pulley 58 may swivel. A bracket 62 is mounted at the top of frame 30 on the cable approach side thereof. A pair of adjacent guide rollers 64 are mounted between bracket 62 and frame 30. Rollers 50, 52, and 64, rotate about axes perpendicular to the axis of rotation of pulley 48 and parallel to axis 46.

A cable 66 being wound onto winch 4 is wrapped around a portion of pulley 58, extends through passage 56, passes between rollers 64, passes between rollers 50, is wrapped around one-half of pulley 48, reverses direction and passes between rollers 52 to the end of the helical configuration on drum 16. Axle 10 is either rotated manually by operating crank arm 12 or driven by an electric motor, not shown. As winch 4 pulls cable 66 onto drum 16 during rotation of axle 10, cable control arm 34 pivots about axis 46 so cable 66 is laid down on drum 16 in contiguous helical turns without crossing or spacing between turns. This is accomplished as described below in detail in connection with FIGS. 5 and 6.

Figure 4:
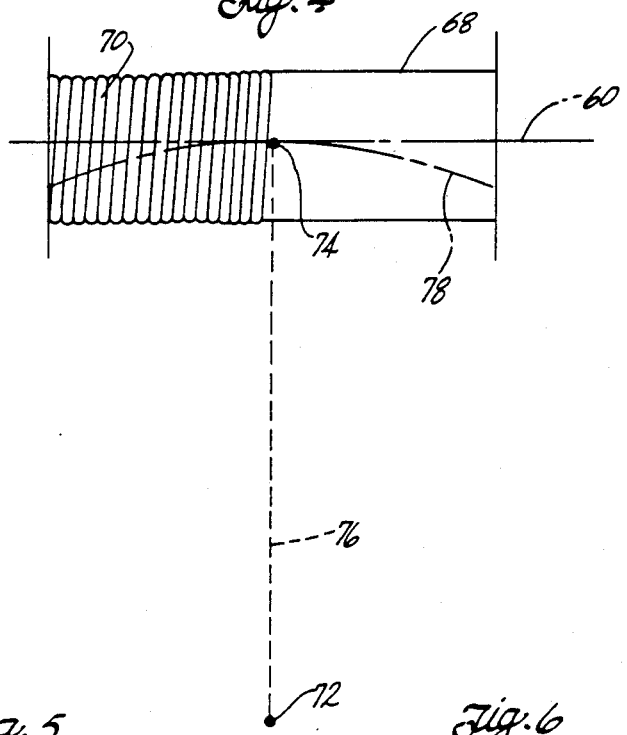
FIG. 4 is a diagram depicting the way a cable tends to wind on a drum in the absence of a level winder.

In FIG. 4, a drum 68 without a level winder is depicted with a cable 70 wrapped thereon in a contiguous helical configuration from one edge to the center of drum 68. The fleet point of the cable being wound on drum 68 is represented at 72 and the point of tangency of drum 68 where cable 70 extending from fleet point 72 meets drum 70 at the center thereof is represented at 74. Fleet point 72 is a stationary point relative to drum 68 about which cable 70 rotates back and forth as it is wound onto drum 68. As cable 70 is wound onto drum 68 from edge to edge, it seeks to maintain the minimum path length between fleet point 72 and drum 68, which is represented by a dashed line 76 between points 72 and 74. An arc having a radius equal to the minimum path length is is represented by a line 78. The locii of points of tangency on drum 68 from edge to edge is represented by a line 80. As illustrated in FIG. 4, the deviation of the points of tangency from arc 78 increases as it moves away from the center of drum 68. This means that as cable is being wound onto drum 68 moving away from the center thereof, the point will be reached where the tendency to maintain the minimum path length will cause cable 70 to cross over the previous turn of the helical configuration and return to the middle of drum 68 rather than to continue forming contiguous helical turns moving toward the edge of drum 68. Thus, unless the distance between the fleet point and the drum is very large relative to the edge-to-edge width of the drum, a cable cannot be wound on a drum in contiguous helical turns from edge to edge without assistance from a level winder.

Figure 5:
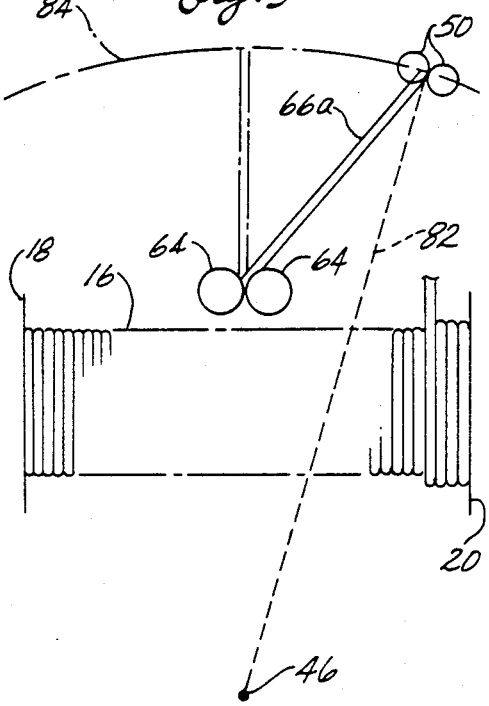
FIG. 5 is a schematic diagram depicting one cable path segment between the fleet point and the drum.
Figure 6:
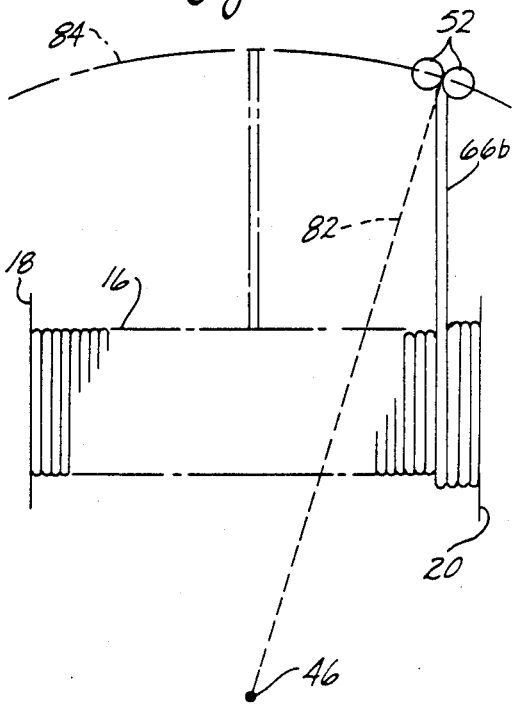
FIG. 6 is a schematic diagram depicting another cable path segment between the fleet point and the drum.

FIGS. 5 and 6 depict drum 16 of the previously described level winder and winch incorproating the principles of the invention and different cable path segments. Cable control arm 34 is represented by a dashed line 82 and the arc of travel of rollers 50 and 52 is represented by a line 84. The fleet point, not shown, can be regarded as the point of initial contact of cable 56 with pulley 58. The length of the cable path segment between pulley 58 and rollers 64 and the length of the cable path segment over pulley 48 between rollers 50 and 52 remain constant. The length of the cable path segment between rollers 64 and rollers 50 represented in the drawings as **66*a* (or between rollers 64 and pulley 48 if the rollers 50 are ignored) and the length of the cable path segment between rollers 52 and drum 16 represented as 66*b* (or the length of the cable between pulley 48 and the drum 16 if rollers 52 are ignored) vary inversely with respect to each other as cable control arm 34 pivots about axis 46. As illustrated in FIG. 5, segment 66*a* has a maximum length at the edge of drum 16 and a minimum length at the center of drum 16. As illustrated in FIG. 6, segment 66*b* has a minimum length at the edge of drum 16 and a maximum length at the center of drum 16. The sum of the lengths of segments 66*a* and 66*b* remains constant, regardless of the angular position of cable control arm 34, and thus, the total path length from the fleet point to the point of tangency of drum 16 also remains constant. Since the cable path length remains constant regardless of the position of cable control arm 34, once cable control arm 34 is positioned so rollers 52 lie directly above the end of the helical configuration on drum 16, the position of cable control arm 34 adjusts itself to lay turn after contiguous turn of cable onto drum 16 from edge to edge of drum 16 in the helical configuration. As axle 10 is rotated to wind cable onto drum 16, the force exerted on the end of cable control arm 34 by the cable from drum 16 and the force exerted on cable control arm 34 by the cable connected to the load being drawn to winch 4 balance each other to position cable control arm 34 such that rollers 52 track the end of the helical configuration on drum 16 at all times, thereby laying down cable in contiguous helical turns from edge to edge, without crossing previously laid turns between the edges of drum 16**.

It is preferable for cable control arm 34 to be rotatable about axis 28 as illustrated in the embodiments of FIGS. 1, 2, and 3 because cable control arm 34 moves away from drum 16 in a counterclockwise direction as viewed in FIG. 1 as each layer of cable is wound on drum 16. This keeps the length of segment **66*b* from changing as a function of the number of layers of cable on drum 16. Alternatively, if cable control arm 34 is sufficiently far away from drum 16, i.e., about 2½ times the drum width from edge to edge, or more, it will operate satisfactorily as a level winder without freedom of movement about an axis perpendicular to axis 46, i.e., when it is fixed except for being pivotal about axis 46. In such case, instead of pulley 58, a fleet point is established at the base of arm 34 by means of a pulley, i.e., sheave, which could be swivel-mounted on base 2**.

Pivotability about winch axis 14 permits the level winder to accommodate vertical changes in fleet angle without increasing the force on pulley 58 and to permit the carrier frame to be moved about to clear space on base 2, as for example a truck bed. In other words, the passage of cable 66 over pulley 58 provides a force to pivot carrier frame 30 about axis 14 when the fleet angle is raised above the surface of base 2. Thus, the described level winder can adjust to vertical changes in fleet angle and carrier frame 30 can be lifted to provide clearance between it and base 2 by raising the fleet angle, as represented by a double dashed line 86 in FIG. 1. Reverse rotation of carrier frame 30 about axis 14 (counterclockwise) as shown in FIG. 1) is prevented by (providing a suitable stop, such as arranging the bars 22 and 24 to strike the base 2. This prevents the arm 34 and the imaginary plane including axis 28 and the axis of pulley 48 from approaching too close to drum 16. Preferably, drum axis 14 is located at some point between axis 28 and the axis of rotation of pulley 48 as shown in FIG. 1.

The swivel capability of pulley 58 permits the level winder to accommodate horizontal changes of fleet angle, i.e., changes in a plane parallel to base 2, as represented by a double dashed line 88 in FIG. 2.

Figure 7:
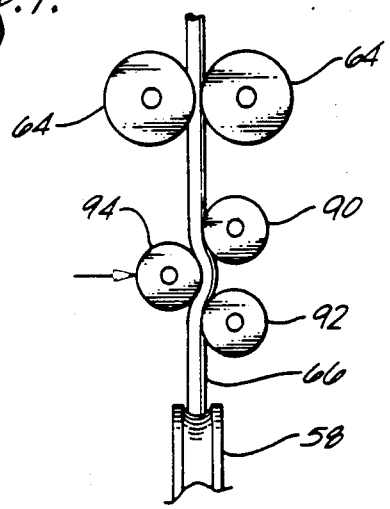
FIG. 7 is a schematic diagram depicting a cable tensioner for the level winder and winch of FIG. 1.

In order for the level winder to assume proper operation after interruption of operation, tension must be maintained on cable 66 during the interruption; otherwise, the last few turns of the helical configuration on drum 16 will loosen up and separate somewhat thereby preventing resumption of proper operation of the level winder. For this reason, a cable-tensioning arrangement is preferably provided in the cable path between pulley 58 and rollers 64 as illustrated schematically in FIG. 7. Spaced apart rollers 90 and 92 are mounted on carrier frame 30 (not shown) on one side of cable 66 and a roller 94 is mounted on carrier frame 30 on the other side of cable 66 between rollers 90 and 92 so as to pinch cable 66 between rollers 90, 92, and 94. Roller 94 is either spring loaded or mounted with a lateral adjustment to bear against cable 66. Other types of cable-tensioning arrangements known to the art could be employed to perform the described function.

Figure 8:
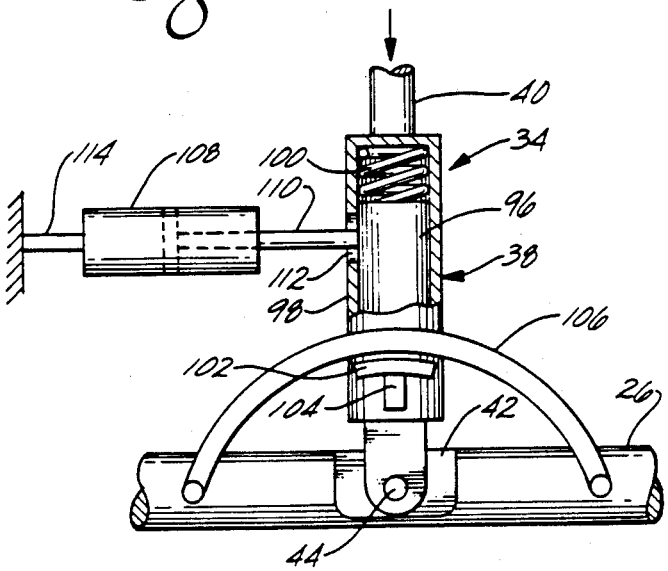
FIG. 8 is a schematic diagram depicting the no-load lock for the control arm associated with the level winder and winch of FIG. 1.

As previously indicated, when operation of the level winder is resumed after an interruption, cable control arm 34 must be positioned directly above the end of the helical configuration. If cable control arm 34 is free to pivot at all times, it will tend to pivot to the edge of drum 16 when tension is removed from cable 66. In order to prevent this from happening and having to then manually reset the position of cable control arm 34 when resuming operation of the level winder, a no-load brake is preferably provided on cable control 34 as illustrated in FIG. 8. Base 38 of cable control arm 34 has a telescoping inner core 96 and outer shell 98 both having a square or rectangular cross section to prevent relative rotation. Inner core 96 is connected to axle 26 by pin 44. Outer shell 98 is axially movable with respect to core 96. Shank 40 is fixed to shell 98. A compression spring 100 is disposed between the end of core 96 and shell 98 to bias the latter away from pin 44. A brake pad 102 is secured to shell 98 by a bracket 104. A semi-circular brake shoe 106 is secured to axle 26 in adjacent relationship to brake pad 102. During operation of the winch and level winder, the tension exerted on cable 66 pushes shell 98 downwardly in opposition to spring 100 so the end of shell 98 bottoms on the end of core 96 and maintains brake pad 102 in spaced relationship from brake shoe 106, as illustrated in FIG. 8. When operation of the winch and level winder is interrupted, tension is removed from cable 66 and spring 100 urges shell 98 upward so brake pad 102 bears on brake shoe 106. As a result when operation of the winch and level winder is interrupted, cable control arm 34 remains locked in the position in which operation was interrupted. In some applications, namely, at sea or on a bumpy road, it is also desirable to provide a pneumatic or hydraulic cylinder 108 for damping sudden forces exerted on cable control arm 34 which would otherwise tend to pivot cable control arm 34 about pin 44. For this purpose, cylinder 108 has a piston arm 110 passing through a slot 112 in shell 98 where it is attached to core 96 and a bracket 114 which secures cylinder 108 to base 2 or other fixed structure.

The described embodiment of the invention is only considered to be preferred and illustrative of the inventive concept; the scope of the invention is not to be restricted to such embodiments. Various and numerous other arrangements may be devised by one skilled in the art without departing from the spirit and scope of this invention.

What is claimed is:

1. A level winder in combination with a winch having a drum on which a cable is wound from a fleet point in a contiguous helical configuration, the drum having an axis of rotation and edges, the level winder comprising:

a cable control arm mounted on support means at one end and pivotable about a first axis lying in a plane extending perpendicular to the plane including the drum axis of rotation and a second axis intersecting the first axis and extending parallel to the drum axis of rotation, the arm having oppositely disposed cable approach and drum approach sides, the cable approach side facing towards the fleet point and the drum approach side facing towards the drum;

a support member attached to said support means on the cable approach side of the control arm;

a first pulley mounted on the support member and rotatable about an axis extending transversely of the cable approach direction to the control arm;

a second rotatable pulley rotatably mounted on the distal end area of said control arm for rotation about an axis extending parallel to the plane including the drum axis, said second pulley arranged to guide the cable and reverse its direction between the cable and drum approach sides of the control arm;

a first pair of opposed guide rollers mounted on the support member between the first and second pulleys, said first pair of guide rollers arranged to guide the cable between the first and second pulleys and to rotate about parallel axes extending perpendicular to the first pulley axis;

the distance between the first pair of guide rollers and said second pulley defining a first cable length and the distance between the second pulley and the drum defining a second cable length when a cable is fitted between the first pulley, the second pulley and the drum;

the geometric relationship between the drum axis, the control arm, first and second axes, and the first and second cable lengths being such that, when said control arm pivots about either or both its first and second axes, the total sum of said cable lengths remains constant while each of said lengths varies inversely relative to the other, whereby a cable approaching the control arm, extending over the pulleys and wrapping around the drum from the drum approach side of the control arm is wound in contiguous helical turns by the force of the approaching cable turns reacting against the control arm and causing its pivotal motion about is first axis, and whereby the reaction force of the cable approaching the drum and progressively encountering a larger diameter surface as the cable is wound on the drum causes the control arm to pivot about its second axis.

2. A level winder as claimed in claim 1, wherein said control arm support means is mounted for motion about a circular arc centered along the drum axis, said second pulley and said second axis being disposed in a common place located towards one side of the drum axis, with the drum axis located between the second pulley and the second axis.

3. A level winder as claimed in claim 2, including a second and third pair of opposed guide rollers on the cable and drum approach sides of the control arm, respectively, said second and third pair of guide rollers disposed between the first pair of guide rollers and the second pulley on the cable approach side and between the second pulley and the drum on the drum approach side, said second and third pair of guide rollers mounted for rotation about parallel axes extending parallel to said second axis of pivotal motion of the control arm.

4. A level winder according to claim 3, including means for limiting pivotal motion of said support means to maintain said common plane away from the drum axis a selected minimum distance.

5. A level winder in combination with a winch having a drum on which a cable is wound in a contiguous helical configuration, the drum having an axis of rotation and edges, the level winder comprising:

a cable control arm freely pivotal at one end about a control arm axis, the control arm axis being in a plane perpendicular to the drum axis, the other end of the control arm extending a substantial distance beyond the drum, the control arm having a first side facing away from the drum and a second side facing toward the drum;

roller means stationary relative to the control arm axis and disposed on the first side of the control arm centrally of its ends for guiding cable to the control arm from a cable pivot point formed at the roller means;

first means defining a cable path segment that extends from the roller means to the other end of the cable control arm, the first means having a pulley at the other end of the control arm to change cable direction and a first pair of adjacent rollers mounted on the first side of the control arm near the pulley to control cable approach to the pulley; and second means defining a cable path segment that extends from the other end of the control arm to the end of the helical configuration on the drum, the second means having a second pair of adjacent rollers mounted on the second side of the control arm near the pulley to control cable departure from the pulley.

* * * * *